US006948434B2

(12) United States Patent
Horiuchi

(10) Patent No.: US 6,948,434 B2
(45) Date of Patent: Sep. 27, 2005

(54) CARDBOARD PALLET

(75) Inventor: Yasuhiko Horiuchi, Yamato-Koriyama (JP)

(73) Assignee: The Pack America Corp., New York, NY (US)

( * ) Notice: Subject to any disclaimer, the term of this patent is extended or adjusted under 35 U.S.C. 154(b) by 101 days.

(21) Appl. No.: 10/446,223

(22) Filed: May 28, 2003

(65) Prior Publication Data

US 2004/0237850 A1 Dec. 2, 2004

(51) Int. Cl.[7] ..... B65D 19/00
(52) U.S. Cl. ..... 108/51.3
(58) Field of Search ..... 108/51.3, 51.11, 108/56.1, 56.3

(56) References Cited

U.S. PATENT DOCUMENTS 2,583,443 A * 1/1952 Perry et al. ..... 108/51.3
2,728,545 A * 12/1955 Hermitage ..... 108/51.3
2,957,668 A * 10/1960 Norquist et al. ..... 108/51.3
3,425,367 A * 2/1969 Oravez ..... 108/51.3
3,434,435 A * 3/1969 Achermann et al. ..... 108/51.3
3,881,429 A * 5/1975 Seymore ..... 108/51.3
4,966,084 A * 10/1990 Motomaru ..... 108/51.3
5,285,731 A * 2/1994 McIntyre ..... 108/51.3
5,809,903 A * 9/1998 Young, Jr. ..... 108/51.3
5,881,652 A * 3/1999 Besaw ..... 108/51.3

FOREIGN PATENT DOCUMENTS

JP 06239346 A * 8/1994 ..... B65D/19/34

* cited by examiner

*Primary Examiner*—Jose V. Chen
(74) *Attorney, Agent, or Firm*—Pitney Hardin LLP

(57) ABSTRACT

A corrugated cardboard pallet is disclosed which bears a load without crushing struts and without destroying beam members even though the pallet is exposed to transverse vibrations generated during transportation by a truck or a transport vehicle. Pallet deck plates are bonded on both the upper and lower surfaces of multiple beam members made of corrugated cardboard. Beam member comprises a body having a first square prism and a second square prism wherein body has a square prism shape by overlaying inner plates of beam members and another inner plate of another beam member on common base platform. The bottom edges of a pair of struts are foldably connected via linking plates; the size of each strut being set such that its side edge contacts an outer plate 6 of each corresponding square prism. Flaps extend toward inner plate in an inclined manner such that flaps contact inner plates thereby providing load-bearing portions. The bottom edge of strut contacts linking plate and the size of flaps that are housed square prisms contacting inner plates is set such that their tips interfere with each other.

10 Claims, 10 Drawing Sheets

CARDBOARD PALLET

FIELD OF THE INVENTION

The present invention relates to a corrugated cardboard pallet wherein beam members and pallet deck plates of the corrugated cardboard pallet are both made of corrugated cardboard, and a method of manufacturing a corrugated cardboard pallet.

BACKGROUND OF THE INVENTION

A variety of corrugated cardboard pallets constructed with beam members and pallet deck plates of conventional technology have been proposed to replace metallic or wooden pallets that have conventionally been used in the transportation industry.

Corrugated cardboard pallets of conventional technology can roughly be classified into two types: (1) a "core" type, having a core of beam members bonded to the bottom surface of a pallet deck plate made of a flat corrugated cardboard, which is further wrapped into a roll or having a core of multiple flat corrugated cardboards stacked atop each other, as disclosed in Japanese Utility Model Laid-open publication JP5-34133 and Utility Model Laid-open publication JP6-78238; and (2) a "hollow" type, having hollow beam members, as disclosed in Japanese Utility Model publication JP62-19543, Japanese Issued Patent JP2,693,715 and Japanese Utility Model Laid-open publication JP6-76053.

FIG. 11 illustrates a corrugated cardboard pallet B having hollow beam members in which pallet deck plates 68 and 69 are bonded onto three beam members 51. Each beam member 5-1 has a common-base platform 55 that is coupled by overlaying an inner plate 58 with another inner plate 58 on a common base platform 55. Two square prisms 53 and 54 are coupled via multiple struts 61 to retain a square prism shape.

FIG. 12 is a perspective bottom up view of beam member 51 on its way of being assembled. Beam member 51 is constructed in such a manner that outer plates 56, bottom plates 57, inner plates 58 are foldably coupled via folding lines at both edges of base platform 55 that is substantially the top plate in the order. A pair of slits 59 is provided in the middle of the upper edge of each inner plate 58. Strut-guiding slits 64 to be joined are provided at the points where strut-guiding slits 64 are joined with another slit 59 on inner plates 58.

Beam member 51 is assembled in a desired square prism shape by folding each of the inner plates 58 inside while making each of the struts 61 stand further outward from the position illustrated in FIG. 12 until struts 61 stand perpendicular to the base platform 55 so as to fit the top of strut 61 to the bottom of inner plates 58 through strut-guiding slits 64 to be joined.

The corrugated cardboard pallet thus assembled bears loads of as much as several hundred kilograms to several thousand kilograms, much better than it looks or the image that the raw materials impart.

SUMMARY OF THE INVENTION

Corrugated cardboard pallets described above do not have any problem as long as a heavy load is applied to a pallet deck plate when the pallet is in storage or the like. However, it has been found that transportation of goods by a vehicle such as a truck could damage beam members during transportation.

The inventors carefully studied the causes of such damage and found that transverse vibrations generated during transportation of goods by a vehicle such as a truck damaged beam members.

In other words, once transverse vibrations are generated, the load also vibrates in response to the initial transverse vibrations generated by a vehicle or other means during transportation. When the load is relatively light, a corrugated cardboard pallet only slides slightly along the floor of the transport vehicle along with the load. If the load is heavier than a certain weight, the pallets vibrate in a transverse direction pressing beam members or the lower deck plates against the vehicle floor.

Then, the sides and the bottom of strut 61 gradually crush. Inner and outer plates 56 and 58 that are supposed to be perpendicular to pallet deck plates 68 and 69 as seen from FIG. 13(*a*) start declining as illustrated in FIG. 13(*b*). Continual generation of transverse vibrations advances declining of both inner plates 56 and outer plates 58. As both inner and outer plates 56 and 58 decline more than a given degree, so called "crouching" occurs thereby collapsing beam members 51.

The present invention is to overcome the above problem and provides a corrugated cardboard pallet that retains the original load-bearing characteristic even during transport of goods by a truck or a vehicle without crushing the struts.

BRIEF DESCRIPTION OF THE DRAWINGS

FIG. 13(*b*) is a diagram showing the beam member of the corrugated cardboard pallet of FIG. 9 after the beam member is exposed to transverse vibrations generated during transportation.

DETAILED DESCRIPTION OF THE PREFERRED EXAMPLES

Figure 1:
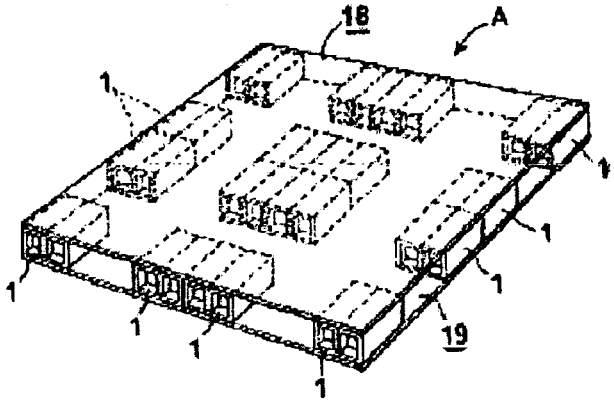
FIG. 1 is a perspective view of an example of the corrugated cardboard pallet of the present invention.

To overcome the problem, a corrugated cardboard pallet characterized by a pallet deck plate that is fixed onto the upper surface and optionally the lower surface of multiple beam members made of a corrugated cardboard is proposed. The beam member comprises a body and struts. More specifically, overlaying the inner plates on a common base platform provides a body, which has a first square prism and a second square prism. Coupling first square prism with second square prism provides a square prism shape to the body. The size of each of the struts is set such that both side edges contact the inner surface of the outer plates of corresponding square prisms, and load-bearing portions are provided on both side edges.

According to an example of the present invention, when heavily loaded corrugated cardboard pallets are exposed to transverse vibrations that are generated during transportation by a vehicle such as a truck, and a force that crushes the outer plates of beam members is applied to the side edges of the struts, the force spreads out from the outer plates through the side edges of the struts to load-bearing portions because the bottom edge of load-bearing portions directly or indirectly touch the base platform of the beam member. Crushing of the edges of struts and destruction of beam members is thus prevented.

It is not always required that a pair of struts be connected to each other. It is desirable, however, that they are coupled with each other because coupled struts are more manageable and easy to assemble.

In light of the coupling mode, either bottom edge to bottom edge coupling via a linking plate or side edge to side edge coupling via a linking plate may be desirable wherein the side edges contact the outer plates of each of the square prisms.

As to the load-bearing portion, it is desirable that the bottom edges of load-bearing portions directly or indirectly touch the base platform of the beam member. This further enhances dispersion of the force applied from the outer plate toward the side edges of the strut.

When the bottom edge of one strut is coupled to the bottom edge of another strut via a linking plate to construct a load-bearing portion, the load-bearing portion is foldably connected via folding lines along the side edges of each strut; the load-bearing portion is made up with flaps that extend toward inner plate in an inclined manner such that the flaps contact the inner plates. It is desirable that the bottom edge of each flap directly or indirectly contact the base platform, and that the size of the flaps housed in the same square prism be set such that tips of the flaps interfere against each other. The function of the load-bearing portions can-thus be enhanced.

In struts, when the side edges contacting the outer plate of one of the square prisms are coupled via a linking plate, the linking plate works as a load-bearing portion. In this case, the linking plate comprises a first linking plate that is foldably connected to one strut and a second linking plate that is foldably connected to another strut. A slit is provided at the end of one of the linking plates and a latch portion is formed at the end of another linking plate in such a manner that the latch portion extends outward at a point which corresponds to the edge of second linking plate. The desirable arrangement at the time when a slit for latching and the latch portion are engaged is that a pair of struts and linking plates are assembled to provide a square shape in a plan view. Handling of a set of square prisms and linking plates of the beam member is thus made easier.

The present invention will be described in detail with reference to examples of the invention illustrated in the drawings.

FIG. 1 illustrates an example of the corrugated cardboard according to the present invention. Corrugated cardboard deck plates 18 and 19 are bonded to both upper and lower surfaces of multiple corrugated cardboard beam members 1 spaced from each other in such a manner that a forklift can insert its fork from all sides.

Figure 2:
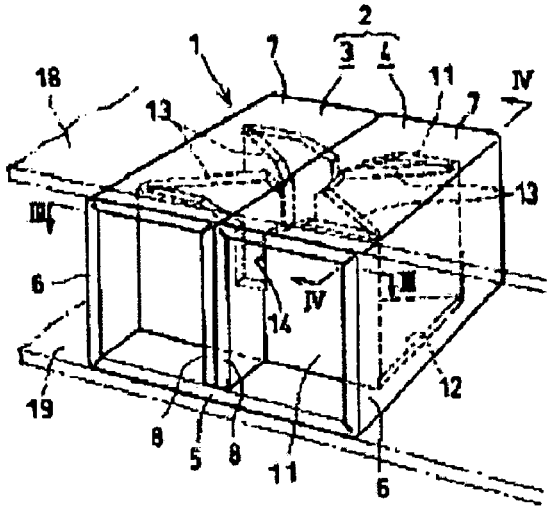
FIG. 2 is a perspective view of the beam member of the corrugated cardboard pallet of FIG. 1.

As illustrated in FIG. 2, a beam member 1 is constructed with a body 2 and struts 11. Overlaying inner plates 8 of first square prism 3 and that of second square prism 4 on a common base platform 5 provides body 2. Struts 11, which are assembled in the manner illustrated in FIG. 5, help coupling the two square prisms 3 and 4 to maintain the square prism shape of beam member 1.

Figure 6:
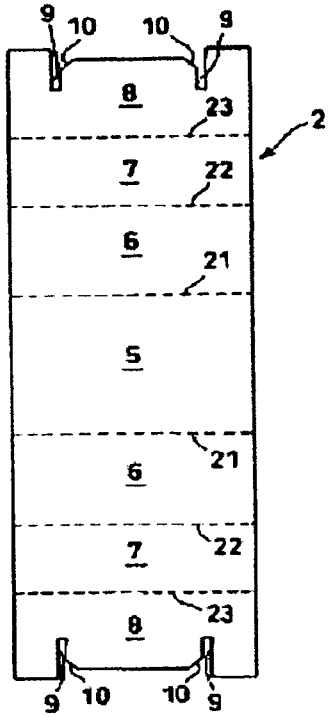
FIG. 6 is a plan view of the body of the beam member of FIG. 2.

FIG. 6 is a view of an extended beam member body 2. Outer plate 6, top plate 7 and inner plate 8 that constitute first square prism 3 are foldably connected to one end of base platform 5 via folding lines 21, 22, and 23, respectively, whereas outer plate 6, top plate 7 and inner plate 8 that constitute second square prism 4 are also foldably connected to the other end of base platform 5 via folding lines 21, 22, and 23, respectively.

In light of the above description, a pair of slits 9 are provided in the middle of the bottom edge of each inner plate 8 in a longitudinal direction. In addition, the portion that is to be latched with struts between a pair of slits 9 is set in such a manner the longitudinal position of the bottom ends of struts 11 is set higher than both sides such that the portion that is to be latched with struts between a pair of slits 9 contacts the upper surface of linking base plate 12 for struts 11 described later. Guiding taper 10 is provided in the vicinity of slits 9 to be coupled to struts.

Figure 7:
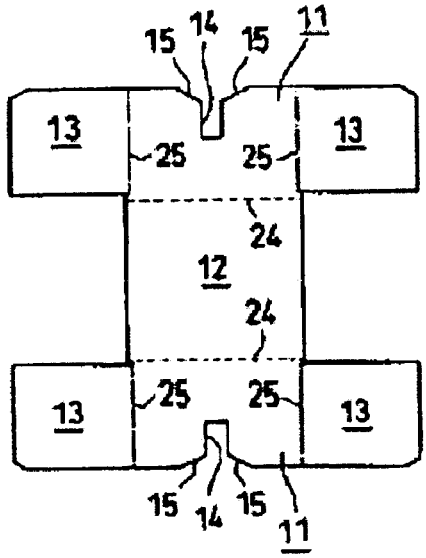
FIG. 7 is a plan view of the strut and load-bearing portion of the beam member of FIG. 2.

FIG. 7 is a plan view of a pair of struts 11 in an extended state. A pair of struts 11 are foldably connected to side edges of linking plate 12 that are facing each other via folding lines 24, and flaps 13 are also foldably connected to side edges of flaps 13 via folding lines 25 wherein flaps 13 work as load-bearing portions.

The size of each strut 11 is set such that, in each strut 11, both side edges of strut 11 contact the inner surfaces of outer plates 6 of square prisms which correspond to ends of side edges, and slit 14 to be latched with the inner plate of a square prism is provided in the center of the upper end in the vertical direction. In the vicinity of the upper end of slit 14 to be latched with the inner plate of a square prism, guiding taper 15 is provided such that inner-plate 8 of a square prism can be easily engaged with slit 14.

Figure 3:
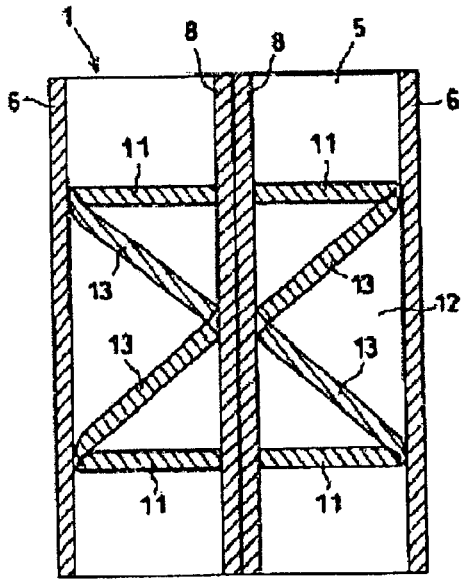
FIG. 3 is an enlarged cross section along line III—III of the beam member of FIG. 2.
Figure 4:
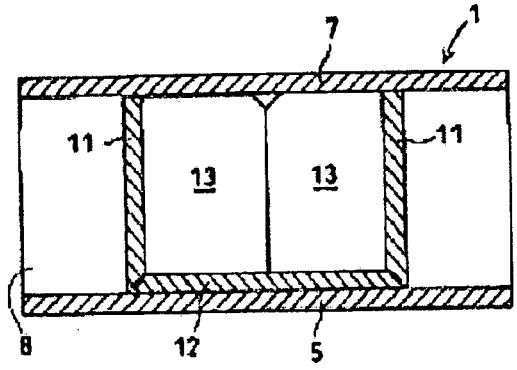
FIG. 4 is a cross section along line IV—IV of the beam member of FIG. 2.

In the assembled beam member 1, as illustrated in FIG. 3, the tip of each flap 13, which works as the load-bearing portion, contacts corresponding inner plate 8, and the size of flaps 13 that are housed in the square prisms 3 or 4 is set such that the tips of flaps 13 interfere with each other. In addition, the bottom edges are set such that they contact linking plates 12 as illustrated in FIG. 4.

Figure 5:
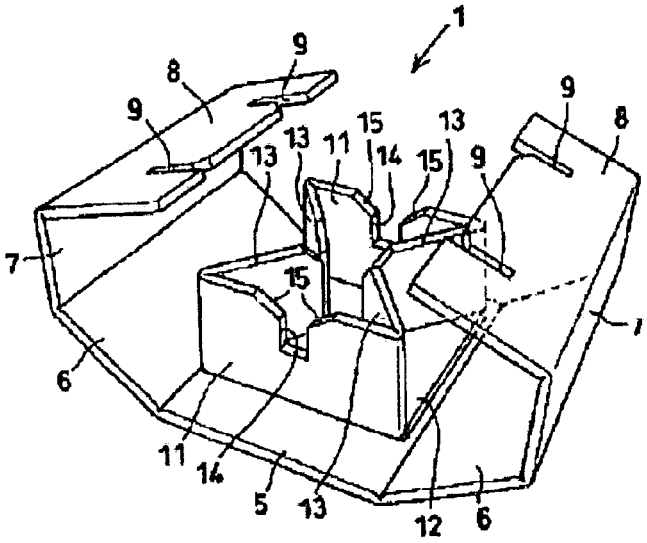
FIG. 5 is a perspective view of the beam member of FIG. 2 on its way to being assembled.

Beam member 1 in the extended state is assembled to make a desired square prism shape in the following manner See FIG. 5 first. Let a pair of struts 11 that are connected to each other via linking plate 12 stand out from linking plate 12; fold each of the strut 13 inside in such a manner that, in one square prism 3 or 4, one half body of strut 11 and flap 13 that are folded inward at the end of strut 11 followed by the other half body of strut 11 and flap 13 that are folded inward at the end of the half body strut 11 are arranged in a "M" shape in a plan view as illustrated in FIG. 3.

Now, let outer plates 6 stand out from both sides of base platform 5 of beam body; fold inner plates 8 inward such that slits 9 are latched with struts corresponding to slits 14 to be latched with inner plates of square prism while bending top plates 7 of first square prism 3 and top plate 7 of second square prism 4 until the top plates 7 become parallel to base platform 5. Finally, fit the center bottoms of struts 11 to slits 14 to be latched with struts and fit slits 14 to be latched with inner plates of square prism to corresponding points of inner plates 8. Assembly of beam member 1 is thus completed.

Then, bond top pallet deck plate 18 and bottom pallet deck plate 19 onto the top of a given number of beam members 1. A desired corrugated cardboard pallet A as illustrated in FIG. 1 is thus obtained.

Nonetheless, when a very heavy load is applied to corrugated cardboard pallet A having the above configuration, and a vehicle such as truck transports the loaded corrugated cardboard pallet A, the transport vehicle generates transverse vibration, causing the load to start vibrating in a transverse direction.

As the load begins to vibrate in the transverse direction, a force, that can not only crush the outer plates 6 of beams but also crush side edges of struts 11 and the upper and bottom edges of the corrugated cardboard pallet A, spreads out taking advantage of the presence of flaps 13 that work as load-bearing portions. In other words, a force applied to the side edges of strut 11 spreads out from linking plate 12 to base plate 5 of beam body through flaps 13, further spreading out to inner plates 8. Crushing of side edges of struts 11 is thus prevented.

For this reason, the critical load with these beam members is much larger than that without such beam members. Destruction of beam members is thus prevented.

FIG. 8(*a*) to FIG. 8(*i*) illustrate in more detail how to assemble each of the beam members 1 by manual process. As shown in FIG. 8(*a*), each of the beam members 1 comprises two separate components made of three-layer corrugated cardboard material, i.e., the body 2 and the struts 11. In FIG. 8(*b*), the strut 11 is inserted into the beam body 2 by mating the slits 14 and 9. The flaps 13 are folded inward as shown in FIG. 8(*c*). The struts 11 are then rolled over as seen in FIG. 8(*d*) and adhesive is applied to portion of the beam body 2 as seen in FIG. 8(*e*). Under these circumstances, the first square prism 3 is folded and completed wherein the flaps 13 are held in "M" shape. Then, the linking plate 12 is bonded to the beam body 2 and the-flaps are folded inward as shown in FIG. 8(*f*). Adhesive is applied to an inner ridge of the first square prism 3 as shown in FIG. 8(*g*). The opposite end of the beam body 2 is folded and the inner plate 8 is inserted into the slits 14 as shown in FIG. 8(*h*). The final product of the beam member 1 is depicted in FIG. 8(*i*).

Figure 9:
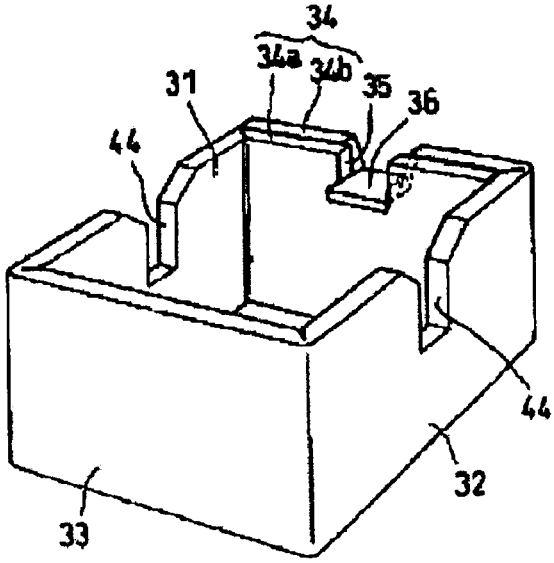
FIG. 9 is a perspective view of the strut and load-bearing portion of the beam member according to an alternate example of the corrugated cardboard pallet of the present invention.
Figure 8B:
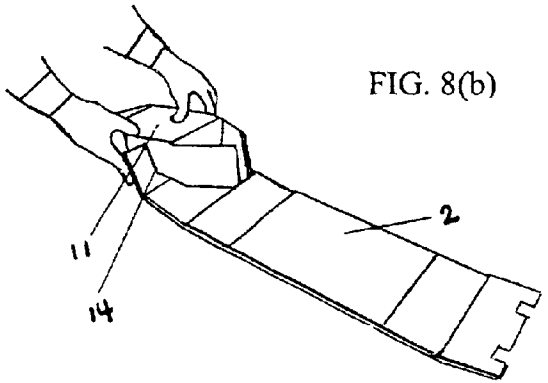
FIG. 8(*a*) to 8(*i*) are perspective views showing how to assemble the beam members.
Figure 8D:
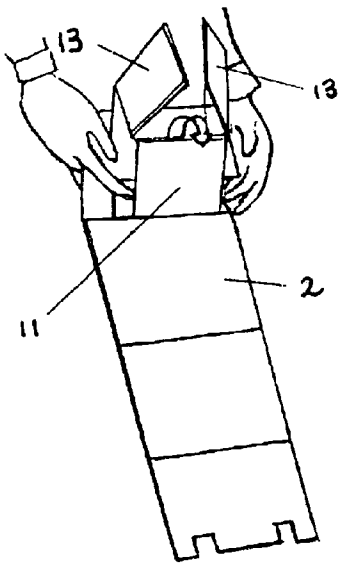
Figure 8A:
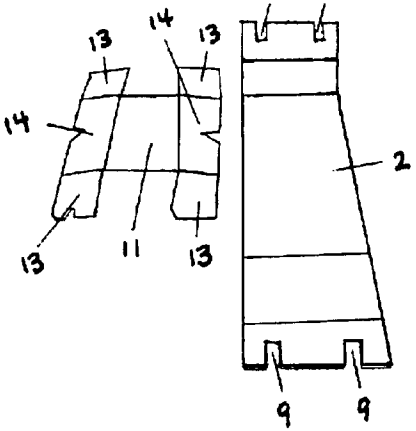
Figure 8C:
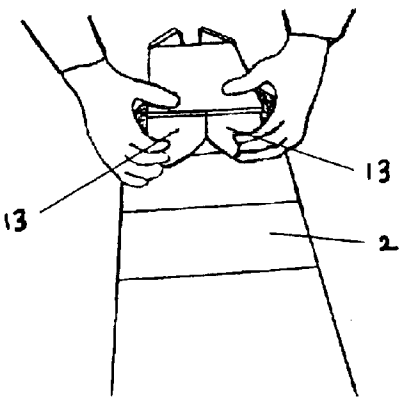
Figure 8F:
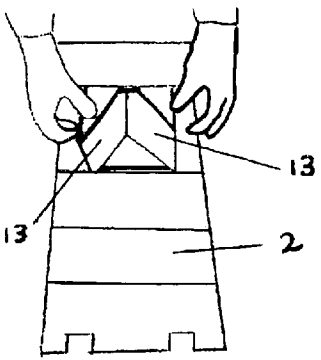
Figure 8H:
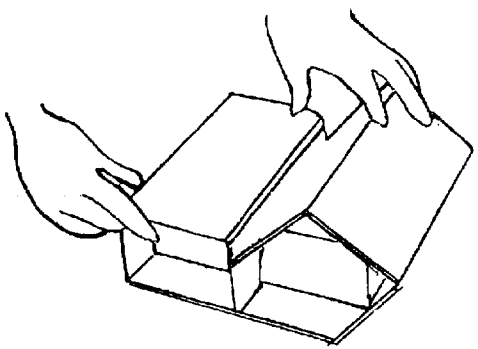
Figure 8E:
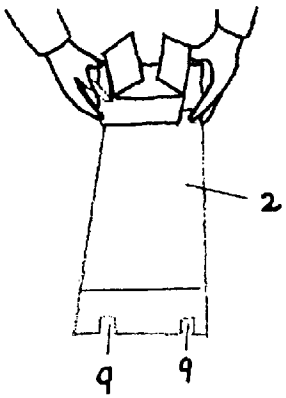
Figure 8G:
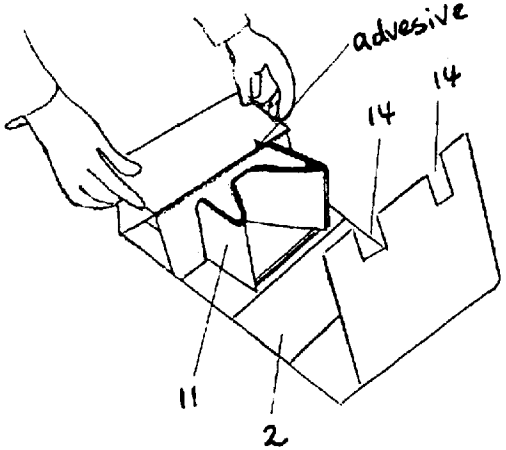
Figure 8I:
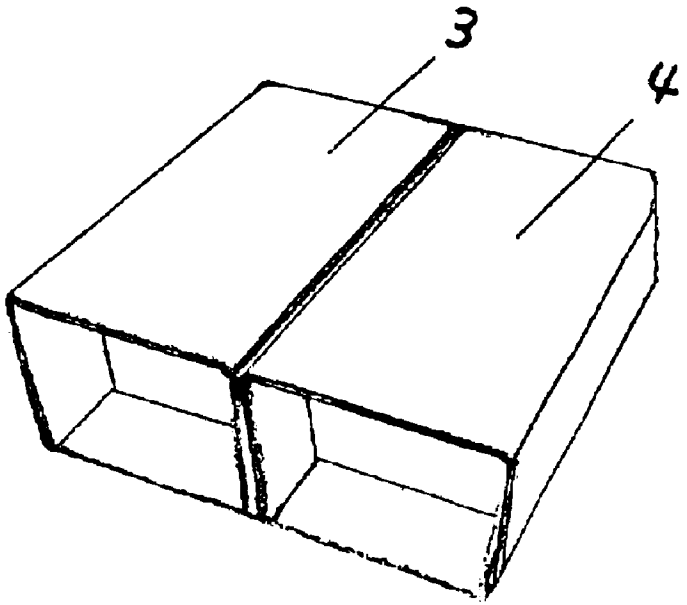

FIG. 9 illustrates the struts and load-bearing portions of a beam member of another example of the present invention. A pair of struts 31 and 32 are foldably connected at the side edges contacting outer plates 6 of either square prism 3 or 4 herein; linking plates 33 and 34 also function as load bearing portions.

In this example, one linking plate 34 comprises first linking plate 34*a* and second linking plate 34*b* wherein first linking plate 34*a* is foldably connected to strut 31 and second linking plate 34*b* is foldably connected to strut 32; latch portion 36 is extended outward at the point which corresponds to the edge of second linking plate 34*b* so as to be engaged with slit 35 of latch portion 36. A pair of struts 31 and 32 and linking plates 33 and 34 are arranged to form a square shape in a plan view when being assembled in a manner that latch portion 36 is engaged with slit 35.

Originally, slits 44 to be latched with inner plates are provided in the top center of struts 31 and 32 in a manner such that struts 11 of the previous example are provided. As a result, struts 31 and 32 that can be arranged in a square shape in plan view can also be used in place of struts 11 of the previous example shown in FIG. 5 to assemble beam member body 2 in a desired prism shape.

Even though the beam member utilizes these struts 31, when a force is applied from the outer plate of the beam member toward the side edges of struts 31 and 32, the force spreads out-to linking plates 33 and 34, which constitute the load-bearing-portion. Crushing of struts 31 and 32 and subsequent destruction of the beam member is thus prevented demonstrating an effect similar to that of the previous example.

As described above, the corrugated cardboard pallet A associated with the present invention comprises a beam member body 2 and struts 11 and 32. The beam member body 2 is made up of first square beam 3 and second square beam 4 that are constructed by overlaying inner plate 8 of first square beam 3 and inner plate 8 of second square beam on a common base platform 5. This configuration helps the beam member body 2 maintain its square beam shape. The size of struts 11 and 32 is set such that two side edges of struts 11 and 32 contact the corresponding inner surfaces of outer plates 6 of both square beams. Further, load-bearing portions 13, 33 and 34 are provided. As a result, when a force is applied to the side edges of struts 11, 31 and 32 through outer plates 6 of the beam member body to crush the side edges, the force spreads out to struts 11, 31 and 32 and further to load-bearing portions 13, 33 and 34. Crushing of struts 11, 31 and 32 and further destruction of the beam member is thus prevented.

When the bottom edges of load-bearing portions 13, 33 and 34 directly or indirectly contact base platform 5 of beam member 1, the force applied on the outer plates 6 of the beam member body spreads out more effectively.

Load-bearing portion 13 comprises flaps 13 wherein flaps 13 are coupled with each other at the side edges of struts 11 via folding lines 25. Flaps 13 extend toward inner plate 8 in an inclined manner; each flap 13 directly or indirectly contacts base platform 5 of beam member 1 at the bottom; the size of flaps 13 that are housed in the square prism 3 or 4 is set such that their tips interfere with each other. The force applied to the outer plates 6 of the beam body further spreads out under the condition described above. Interference among the tips of flaps 13 further prevents rebound in a direction toward outer plate 6 derived from restoration of resiliency.

Foldably connecting the bottom edges of a pair of struts 11 via linking plate 12 provides easier assembly.

In a pair of struts 31 and 32, when side edges contacting outer plates 6 of one of the square prisms 3 and 4 are coupled via linking plates 33 and 34 while utilizing linking plates 33 and 34 as load-bearing portions, assembly of beam member 1 becomes much easier.

A linking plate 34 comprises a first linking plate 34*a* that is foldably connected to strut 31 and a second linking plate 34*b* that is foldably connected to strut 32. Slit 35 is provided at the end of one of either linking plate 34*a* or 34*b* respectively while latch portion 36 extends outward at a point which corresponds to the end of another linking plate 34*b* or 34*a* respectively such that slit 35 is engaged with latch portion 36. A pair of struts 31 and 32 and linking plates 33 and 34 provides a square shape in a plan view when being assembled in such a manner that latch portion 36 engages with slit 35. The assembly of beam member 1 is thus made easier.

Figure 10:
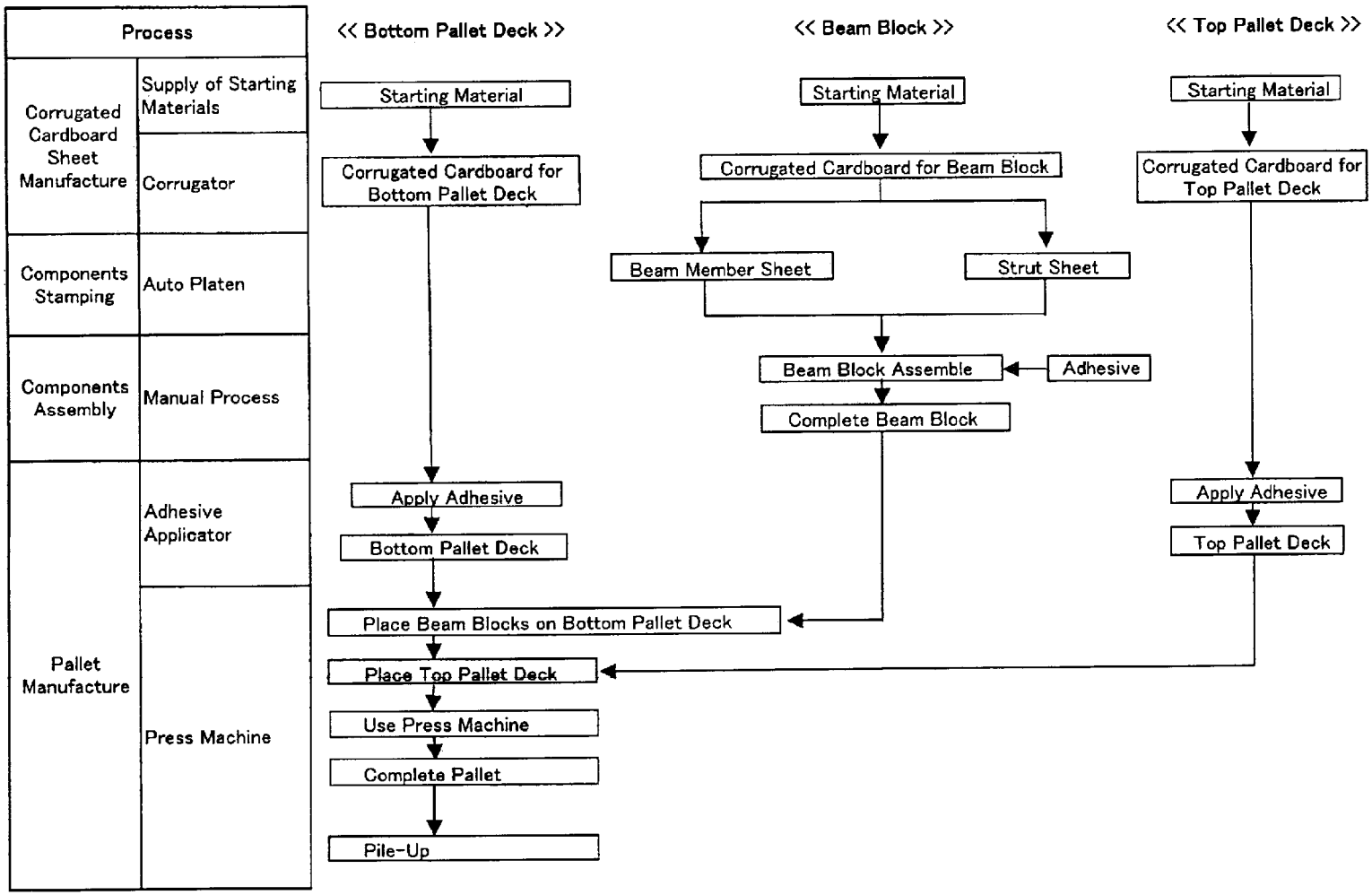
FIG. 10 is a flow chart showing how to make the beam members and top and bottom decks.
Figure 11:
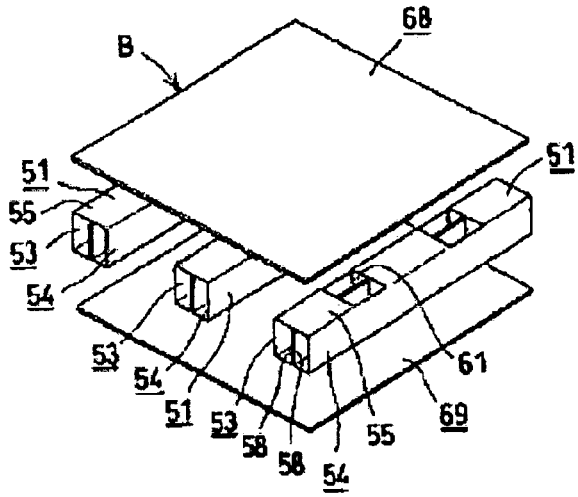
FIG. 11 is a perspective view of a disassembled corrugated cardboard pallet of conventional technology.
Figure 12:
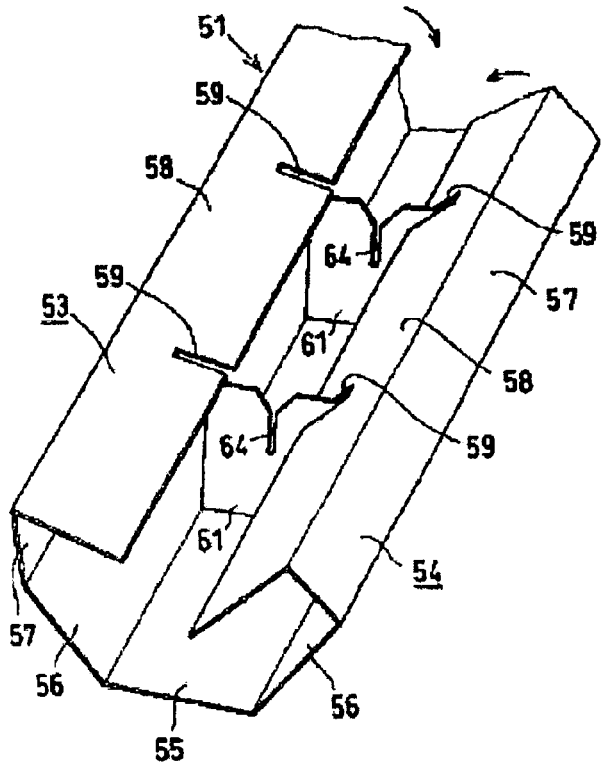
FIG. 12 is a perspective view of the beam member of a corrugated cardboard pallet of conventional technology of FIG. 9.
Figure 13:
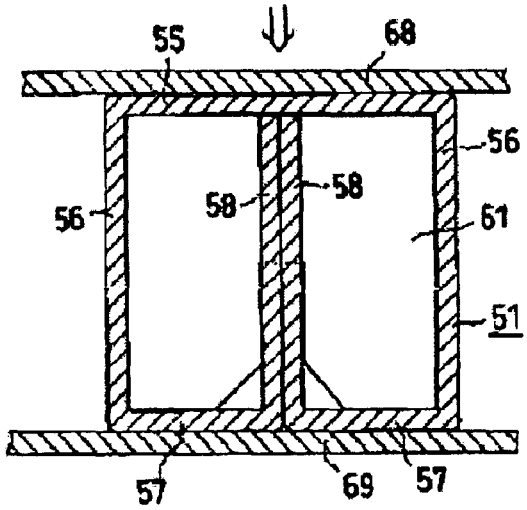
FIG. 13(*a*) is a diagram showing the beam member of the corrugated cardboard pallet of FIG. 9 before the beam member is exposed to transverse vibrations generated during transportation.
Figure 13:
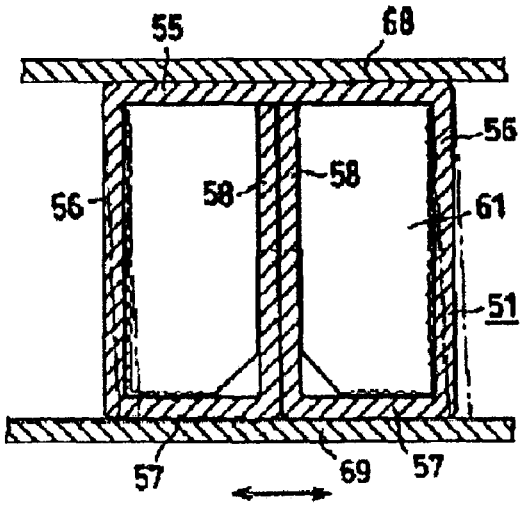

FIG. 10 illustrates a flow chart for manufacturing a corrugated cardboard pallet A. As illustrated in FIGS. 8(*a*) to 8(*i*), the beam body 2 and the struts 11 both of which are made of corrugated cardboard material are prepared to complete beam "M" blocks. Top pallet deck plate 18 and bottom pallet deck plate 19 are also made of a corrugated cardboard material. A predetermined number of the beam "M" blocks are placed on the bottom pallet deck plate 19 and the top pallet deck plate 18 is placed over the bottom pallet deck plate 19 via the beam "M" blocks and processed with a press machine to complete the manufacture of the corrugated cardboard pallet A. As seen from FIG. 10, the beam blocks are made through manual process to eliminate the need of complicated and expensive automatic working tools, so that a manufacturing plant for making the bottom pallet decks and the beam blocks are simplified and made inexpensive.

Results of tests conducted by Technology Research Institute of Osaka Prefecture (Osaka, Japan) on the corrugated cardboard pallet made according to the present invention were satisfactory as follows:

| | |
|---|---|
| Test conditions (temp, humidity and hours): | 23° C., 50% and 24 hours |
| Dimensions (mm): | 1100 × 1100 × 115 |
| Deck Board: | Alternate pasting |
| Deck Board Material: | K7 (top liner) × S (middle core) × K7 (bottom liner) |
| Beam Dimensions (mm): | 200 × 200 × 98 H |
| Beam Material: | Ⓐ S180, K6 × S × K6 |
| Beam Arrangements: | Insertable by forklift from all four directions (total nine beams) |
| Load Weight (N): | 25 mm deformation - 50,245<br>Maximum load weight - 69,805 |
| Vibration: | Horizontal, 30 min - nothing abnormal observed<br>Vertical, 30 min - nothing abnormal observed |

In the above test results, K designates kraft paper and S designates semi-chemical pulp. It is noted that the materials for the deck board are different from that for the beam blocks in terms of load weight, with the former bearing heavier load weight.

While only a few examples of the present invention have been shown and described, it is to be understood that many changes and modifications may be made thereunto without departing from the spirit and scope of the invention as defined in the appended claims.

What is claimed is:

1. A corrugated cardboard pallet comprising a pallet deck plate and multiple beam members made of corrugated cardboard fixed onto an upper surface of the pallet deck plate, wherein each of said beam members comprises a foldable body having a pair of inner plates and a pair of outer plates and a pair of foldable struts, said foldable body being folded to define a first square prism between one of the inner plates and one of the outer plates and a second square prism between the other of the inner plates and the other of the outer plates, the inner plates of said body in the folded condition facing against each other to form a square prism shape for said body on a common base platform by coupling said first and second square prisms together, and wherein the pair of said struts is each located respectively within the first and second square prisms and the size of the pair of said struts is set such that the both side edges of said struts contact inner surfaces of said outer plates of the foldable body to maintain the square prism shape for said body, and the pair of said struts has load-bearing portions on both side edges of the pair of said struts.

2. The corrugated cardboard pallet as set forth in claim 1 wherein the bottom edge of said load-bearing portion directly or indirectly contacts the base platform of said beam member.

3. The corrugated cardboard pallet as set forth in claim 2 wherein said load bearing portion is made of flaps, said flaps being foldably coupled with each other at the side edges of each of said struts via folding lines and flaps extend toward inner plates in an inclined manner and contact inner plates, wherein the bottom edge of each flap directly or indirectly contacts base platform of said beam member and the size of flaps that are housed in the same square prism or is set such that tips of said flaps interfere with each other.

4. The corrugated cardboard pallet as set forth in claim 1 or 3 wherein the bottom edges of the pair of said struts are foldably coupled with each other via linking plate.

5. The corrugated cardboard pallet as set forth in claim 1 or 2 wherein side edges of the pair of said struts that contact the outer plates of one of the square prisms are coupled with each other via linking plates; said linking plates also provide a load-bearing portion.

6. The corrugated cardboard pallet as set forth in claim 5 wherein said linking plate comprises: a first linking plate that is foldably connected to the struts; and a second linking plate that is provided in a manner that it is foldably connected to the struts, wherein a slit is provided at the end of either one of linking plates and a latch portion is provided in a manner that it extends outward; a pair of struts and linking plates are arranged to form a square shape in a plan view when assembled in such a manner that latch portion engages with slit.

7. A corrugated cardboard beam member made of corrugated cardboard comprising a foldable body having a pair of inner plates and a pair of outer plates and a pair of foldable struts, wherein said foldable body is folded to define a first square prism between one of the inner plates and one of the outer plates and a second square prism between the other of the inner plates and the other of the outer plates, the inner plates of said body in the folded condition facing against each other to form a square prism shape for said body on a common base platform by coupling said first and second square prisms together, and wherein the pair of said struts is each located respectively within the first and second square prisms and the size of the pair of said struts is set such that the both side edges of said struts contact inner surfaces of said outer plates of the foldable body to maintain the square prism shape for said body, and the pair of said struts has load-bearing portions provided and arranged in an "M" shape in a plan view on both side edges of the pair of said struts.

8. A method of manufacturing a corrugated cardboard pallet characterized by a pallet deck plate fixed onto at least an upper surface of multiple beam members made of corrugated cardboard, wherein said beam member comprises a foldable body having a pair of inner plates and a pair of outer plates and a pair of foldable struts, wherein said foldable body is folded to define a first square prism between one of the inner plates and one of the outer plates and a second square prism between the other of the inner plates and the other of the outer plates, the inner plates of said body in the folded condition facing against each other to form a square prism shape for said body on a common base platform by coupling said first and second square prisms together, and wherein the pair of said struts is each located respectively within the first and second square prisms and the size of the pair of said struts is set such that the both side edges of said struts contact inner surfaces of said outer plates of the foldable body to maintain the square prism shape for said body, and the pair of said struts has load-bearing portions on both side edges of the pair of said struts.

9. A method of manufacturing a corrugated cardboard beam member for use with pallet characterized by a pallet deck plate fixed onto an upper surface of multiple beam members made of corrugated cardboard, comprising the steps of:

preparing a beam member of corrugated cardboard said beam member comprising a foldable body having a pair of inner plates and a pair of outer plates, said foldable body being folded to define a first square prism between one of the inner plates and one of the outer plates and a second square prism between the other of the inner plates and the other of the outer plates, the inner plates of said body in the folded condition facing against each other to form a square prism shape for said body on a common base platform by coupling in said first and second square prisms together, and preparing a pair of struts of corrugated cardboard wherein the pair of said struts is each located respectively within the first and second square prisms and the size of the pair of said struts is set such that the both side edges of said struts contact inner surfaces of said outer plates of said foldable body to maintain the square prism shape for said body, and the pair of said struts has load-bearing portions on both side edges of the pair of said struts.

10. A method of manufacturing a corrugated cardboard beam member for use with pallet characterized by a pallet deck plate fixed onto an upper surface of multiple beam members made of corrugated cardboard, comprising the steps of:

preparing a beam member of corrugated cardboard, said beam member comprising a foldable body having a pair of inner plates and a pair of outer plates, said foldable body being folded by manual process to define a first square prism between one of the inner plates and one of the outer plates and a second square prism between the other of the inner plates and the other of the outer plates, the inner plates of said body in the folded condition facing against each other to form a square prism shape for said body on a common base platform by coupling said first and second square prisms together, and preparing a pair of struts of corrugated cardboard wherein the pair of said struts is each located respectively within the first and second square prisms and the size of the pair of said struts is set such that the both side edges of said struts contact inner surfaces of said outer plates of said foldable body to maintain the square prism shape for said body, and the pair of said struts has load-bearing portions on both side edges of the pair of said struts.

* * * * *